US009919359B2

(12) United States Patent
Sterkenburg

(10) Patent No.: US 9,919,359 B2
(45) Date of Patent: Mar. 20, 2018

(54) METHOD OF AND A DEVICE FOR THE COMPACTION OF A POWDER INTO A CUTTING INSERT GREEN BODY

(71) Applicant: SECO TOOLS AB, Fagersta (SE)

(72) Inventor: Dirk Sterkenburg, Gustafs (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 15/303,659

(22) PCT Filed: Mar. 20, 2015

(86) PCT No.: PCT/EP2015/055879

§ 371 (c)(1),
(2) Date: Oct. 12, 2016

(87) PCT Pub. No.: WO2015/158493

PCT Pub. Date: Oct. 22, 2015

(65) Prior Publication Data

US 2017/0028470 A1 Feb. 2, 2017

(30) Foreign Application Priority Data

Apr. 16, 2014 (EP) ..... 14164867

(51) Int. Cl.

| | |
|---|---|
| ***B22F 3/03*** | (2006.01) |
| ***B22F 3/00*** | (2006.01) |
| ***B22F 5/10*** | (2006.01) |
| ***B30B 11/02*** | (2006.01) |
| ***B30B 15/02*** | (2006.01) |
| ***B30B 15/30*** | (2006.01) |

(Continued)

(52) U.S. Cl.

CPC ..... *B22F 3/004* (2013.01); *B22F 3/03* (2013.01); *B22F 5/10* (2013.01); *B30B 11/02* (2013.01); *B30B 15/022* (2013.01); *B30B 15/304* (2013.01); *B30B 15/32* (2013.01); *B22F 2003/033* (2013.01); *B22F 2005/001* (2013.01); *B22F 2998/10* (2013.01)

(58) Field of Classification Search

CPC ..... B22F 3/03; B22F 2005/001
USPC ..... 425/78, 330, 352, 356, 348 S; 264/100, 264/107, 109

See application file for complete search history.

(56) References Cited

U.S. PATENT DOCUMENTS 4,298,563 A 11/1981 Desantis et al.
4,906,294 A * 3/1990 von Haas ..... B23B 27/141 175/425

(Continued)

*Primary Examiner* — Colleen P Dunn
*Assistant Examiner* — Rajinder Bajwa
(74) *Attorney, Agent, or Firm* — Corinne R. Gorski

(57) ABSTRACT

A device for manufacturing a cutting insert green body by compacting a powder includes a first punch, a second punch having a punch edge that has a curvature around the circumference of the punch edge that is at least partially non-perpendicular with a pressing axis of the device, a first die part, and a second die part. When the first and second die parts are joined together when filling the die with powder, one of the first and second die parts is on top of the other and, when the device is in a position ready for filling of powder into the die, the device presents a cavity defined by the lower die part, a punch being introduced into the lower and upper die part. An opening in an upper end surface of the upper die part enables filling of the powder into the cavity.

22 Claims, 8 Drawing Sheets

(51) Int. Cl.
*B30B 15/32* (2006.01)
*B22F 5/00* (2006.01)

(56) References Cited

U.S. PATENT DOCUMENTS

2006/0165828 A1* 7/2006 Smilovici ..... B22F 3/03
425/78
2016/0121516 A1* 5/2016 Bolander ..... B22F 3/02
264/109

* cited by examiner

METHOD OF AND A DEVICE FOR THE COMPACTION OF A POWDER INTO A CUTTING INSERT GREEN BODY

RELATED APPLICATION DATA

This application is a § 371 National Stage Application of PCT International Application No. PCT/EP2015/055879 filed Mar. 20, 2015 claiming priority of EP Application No. 14164867.5, filed Apr. 16, 2014.

TECHNICAL FIELD

The present invention relates to a method for the compaction of a powder into a cutting insert green body. It also relates to a device for the compaction of a powder into a cutting insert green body, as well as a cutting insert produced from a cutting insert green body produced by means of said device.

The invention relates to the technical field in which cutting inserts, preferably to be used for the machining of metal by milling, drilling or turning or by similar chip forming methods, are produced from a powder which is compacted into a green body and then subjected to a sintering process in which the compacted green body is further densified. Typically, the sintered body is then provided with a suitable wear resistant coating, such as a carbide, nitride, carbonitride, oxide, or boride with any suitable contemporary technique, such as physical vapour deposition or chemical vapour deposition.

BACKGROUND OF THE INVENTION

In connection to the compacting of a powder to a green body during production of cutting inserts, the powder is introduced into a cavity defined by a die. Normally, the die comprises an upper opening through which the powder is introduced into said cavity and through which, during a subsequent pressing step, an upper punch is introduced into the die. Typically, there is also provided a lower punch which is able of sliding through a tunnel, often referred to as a bore or pressing bore, in the die and which will form at least part of a bottom of said die cavity and by means of which the green body formed upon compaction of the powder is ejected from the surrounding die. From the upper opening of the die there is provided a punch tunnel, also often referred to as a bore or pressing bore, in which the upper punch is able to move downwards for the purpose of contacting the powder and subjecting it to a compacting pressure. In other words, the punch tunnels contribute to the definition of the die cavity provided for receipt of the powder, and the punches are provided for the purpose of compacting a powder received in said cavity.

After compaction of the powder into a green body, the upper punch is retracted out of the die, and the green body is ejected by a motion of the lower punch relative to the die (either of these components could be the one which is moving). Accordingly, the green body is ejected through the tunnel in which the upper punch was moving downwards into the die during the pressing step.

Typically, the material of the green body is of such nature that it will expand when the compacting pressure from the punches is relieved and when it is ejected and released from the surrounding die. In order to enable the green body to expand radially when it is ejected from the cavity in which it has been compacted, the tunnel is widened slightly above the level to which the upper punch is forwarded during compaction. It could be said that the cavity is provided with a release portion having a certain inclination angle of the inner wall of the die relative a centre axis of the cavity. The inclination angle (possibly also referred to as the release angle) as well as the length (in the vertical direction) of the release portion is adapted to the expected (radial) expansion of the green body upon ejection thereof.

Typically, for positive inserts the cavity has a cross section that narrows as seen from the release portion to the remaining (lower) part of the cavity. Upon compaction of the powder, a lower edge of the upper punch, which is defined by the intersection of a lateral surface and a bottom surface thereof, is not allowed to come into contact with the inner peripheral surface of the die, since such contact might result in damages on both die and punch. Therefore, the punch is only forwarded to a level at which there will be a small gap between said punch edge and the inner peripheral surface of the die. During compaction of the powder, the latter will to some extent leak out and to some extent be extruded out through said gap and into the release portion. The leakage will result in gathering of loose powder in the release portion and the extrusion and/or leakage will result in a residual edge being formed on the green body along the upper edge thereof, which needs to be treated, i.e. at least partly removed, before the subsequent sintering of the green body. Such treatment is time-consuming and contributes to unwanted production costs. The loose powder gathered as a result of said leakage, on the other hand, results in unwanted loss of material and will have a negative influence on the surface finish of the compacted body as the latter is ejected out of the die, especially if the radius of the edge of compacted body is very small and thereby sensitive to interaction with loose powder. Further negative effects of powder leakage and extrusion may also be an unwanted effect on the shape of the upper edge of the green body or a lower density, i.e. a generation of porosity, in the region of the upper edge of the green body.

The present applicant has considered a solution, to the above-mentioned problem, according to which the die is subdivided into an upper part and a lower part, and wherein the die cavity that will define the geometry of the green body in the final compaction position of the punches is housed in the lower die part. During compaction, the upper punch is advanced through the upper die part and into the lower die part. The parting plane between the upper and lower die parts is just slightly above the level to which the edge of the upper punch is advanced in the final compaction position thereof. During filling of the die with powder, the upper die and the upper punch is held in a retracted position above an upper opening in the lower die part. The parting plane is generally flat and a powder-filling device is permitted to slide on an upper surface of the lower die part to and from a position on top of said upper opening. Typically, the powder is filled to the same level in the die as the upper surface of the lower die. After filling of powder, the upper die is joined with the lower die, and compaction is performed by means of the lower punch and the upper punch. When the compacted green body is subsequently to be displaced out of the die, the upper die part is removed from the lower die part before said displacement of the green body. Thanks to this principle solution and design of the die, the release portion into which powder may leak and form a residual edge during compaction can be kept very small.

Preferably, the length of the release portion, i.e. the distance in the direction of the pressing axis from the punch edge (in its final compaction position) to an edge that defines the upper opening in the upper surface of the lower die part should be generally the same all around the circumference of the punch. Therefore, in an application in which the punch edge of the upper punch is partly non-perpendicular to the pressing axis of the upper punch, said edge that defines the upper opening in the upper surface of the lower die part should be correspondingly partly non-perpendicular. If, for example, the punch edge has a wave-like extension, i.e. a varying position in the direction of the pressing axis around the circumference of the punch, the edge that defines the upper opening in the upper surface of the lower die part should have a corresponding wave-like extension. As a result thereof, the upper surface of the lower die will not be planar, and will not allow a powder-filling device having a generally plane bottom surface to be slid to a position on top of the upper opening in the lower die part and fill the lower die part with powder to the level of the edge that defines said upper opening. There is also a risk of having powder escaping to the upper surface of the lower die part in connection to such a filling.

The Object of the Invention

The object of the invention is to present a method and device that solve the above-mentioned problem regarding the generation of an unwanted residual edge and the problem of how to achieve an efficient and reliable powder-filling procedure in the case when the punch edge, and the adjacent edge that defines an opening in a surface of the relevant die part, are at least partly non-perpendicular to the pressing axis.

SUMMARY OF THE INVENTION

The object of the invention is achieved by means of a method of compacting a powder into a cutting insert green body, comprising the steps of:

providing a compaction device comprising a first punch, a second punch that presents an abutment surface for abutment with the powder to be compacted, and an outer peripheral surface, and a punch edge at the intersection between the abutment surface and the outer peripheral surface, wherein the punch edge extends with a predetermined curvature around the circumference of the second punch, a first die part, presenting a chamber having an inner peripheral surface which corresponds to a peripheral surface of a cutting insert green body to be compacted in said first die part, a bore for receiving said first punch, said bore extending from an opening in a first end surface of the first die to said chamber, and an opening region extending with an expanding cross-section from said chamber to an opposite second end surface of the first die part and defining an opening in said opposite second end surface, a second die part, presenting a bore for receiving said second punch, said bore extending from an opening in a first end surface of the second die part to a second end surface thereof, thereby defining an opening in said second end surface, wherein an edge that defines said opening in the second end surface of the first die part extends with a curvature corresponding to said curvature of the punch edge, arranging the second end surface of the first die part and the second end surface of the second die part contiguously such that said opening in the second end surface of the first die part meets said opening of the second end surface of the second die part, positioning the device such that one of said first and second die parts is contiguously arranged above the other die part, arranging said first end surface of the one of the die parts being arranged above the other die part such that it extends rectilinearly in at least one direction, introducing one of said punches into the bore of the one of the die parts being arranged below the other die part, said method being characterized in that said predetermined curvature of the punch edge of the second punch is at least partly non-perpendicular to a pressing axis of the device and that the edge of the opening in the second end surface of the first die part presents a corresponding curvature with regard to said pressing axis, and that the method comprises the further step of filling powder into a cavity defined by the one of the first and second die parts being arranged below the other die part, the punch introduced therein and the one of the first and second die parts being arranged above the other die part by introducing the powder through the opening in the first end surface of the one of the first and second die parts being arranged above the other die part.

A punch edge with a curvature partly non-perpendicular to the pressing axis may be referred to as a punch edge following a line around the circumference of the punch that has a certain curvature, for example a predetermined wave-shape, such that, for different angular positions along said line, the position of the punch edge in the direction of the pressing axis differs. Preferably, the pressing axis of the second punch is parallel to, preferably coinciding with, a longitudinal centre axis of the second punch. Since the edge that defines the opening in the second end surface of the first die part has a corresponding curvature, parts of said edge will define an irregularity (curvature) of said second end surface that makes the latter unsuitable for the purpose of advancing a powder-filling device by way of sliding to and from a position on top of said opening in the second surface of the first die in those cases when the first die part forms the lower die part. If the first die part forms the upper die part, the second surface of the second die will pose a corresponding problem. The present invention presents a solution that avoids using a surface presenting such an irregularity that reflects the curvature of the punch edge as the base for a powder-filling device that is used for filling powder into the die. Instead, a surface which does not need to reflect the curvature of the punch edge may be used as such a base for a powder filling device. The term "contiguously" as used above and hereinafter does not necessarily mean that there is direct physical contact between parts joined to each other. However, preferably, joined surfaces that are contiguously arranged in relation to each other are also in bearing direct contact with each other in order to imply stability to the device.

According to one embodiment, the method of the invention comprises the further step of compacting the powder introduced into said cavity by advancing the other of said first and second punches through the bore of the one of the die parts being arranged above the other die part towards said chamber to a final compacting position. Advancing a punch into the upper die part through the opening in the first end surface thereof will be necessary in order to compact the powder housed in said cavity, regardless of which of the first and second die part that is positioned on top of the other. If the first die part is the die part being arranged above the other die part, the first punch is advanced downwards into the latter through the opening in the first end surface thereof. If the second die part is the die part being arranged above the other die part, the second punch is advanced downwards into the latter through the first end surface thereof.

According to yet an embodiment, the method of the invention comprises the step of compacting the powder introduced into said cavity by advancing the second punch through the second die part until the punch edge is at a distance from said inner peripheral surface of said chamber of the first die part so short that an edge of the compacted green body will be formed in the region in which said punch edge is adjacent to said inner peripheral surface.

Preferably, the second punch is advanced until the distance between the punch edge and the inner peripheral surface of the chamber in the first die part is equal to or less than 50 μm, preferably equal to or less than 30 μm. Even more preferably, the maximum distance is equal to or less than 10 μm or equal to or less than 5 μm. The distance between the punch edge and the inner peripheral surface of the chamber may differ along the circumference of the second punch. It is, however, preferred that it is relatively constant around said circumference. The smaller the distance between punch edge and peripheral surface, the better suppression of the generation of a residual edge on the compacted green body as a result of powder leaking out through the gap between punch edge and inner peripheral chamber surface. However, the punch edge must not be in contact with the inner peripheral surface of said chamber, since such contact may damage the edge and/or the inner peripheral surface.

According to one embodiment, the method of the invention further comprises the steps of exposing the compacted cutting insert green body by retracting the first die part from the second die part (relative motion between said parts; anyone could be the moving one), and displacing the compacted green body out of the first die part through the opening in the second end surface thereof. Even though the invention may be applied in connection to die designs according to which the first die is subdivided into two or more parts that have a parting plane non-perpendicular to the pressing axis and permit separation from each other in a direction perpendicular to the pressing axis for the purpose of closing the cavity before filling or exposing the compacted green body, the invention is particularly suitable for a die design according to which the compacted green body is displaced through said opening in the second end surface of the first die part. The correspondence between the curvature of the punch edge (and edge of the green body) and the curvature of the edge of the opening in the second end surface of the first die part enables a very short and constant release portion in the opening region that extends from said chamber to the edge that defines the opening in the second end surface of the first die part.

According to one embodiment of the invention, the method thereof comprises the step of providing a region around said opening in the second surface of the second die part with a curvature corresponding to the curvature of the edge that defines the opening in the second end surface of the first die part, such that the second surface of the second die part will be in a sealing relation with said edge of the first die part when the first and second die parts are joined. Thereby, powder is prevented from leaking into any space between the second surface of the first die part and the opposing second end surface of the second die part, or even leaking out of the die.

According to one embodiment, the method of the invention comprises the step of providing a powder-filling device and positioning it on top of said opening in the first end surface of the one of the first and second die parts being arranged above the other die part or removing it from said position by permitting it to slide on said first end surface of the one of the first and second die parts being arranged above the other die part in said direction in which said surface extends rectilinearly.

According to yet another embodiment, the compacted cutting insert green body has the shape of a positive cutting insert, and the inner peripheral surface of said chamber in the first die part has a corresponding shape, with a cross section cross wise to the pressing axis that increases towards the opening in the second end surface of the first die part.

The object of the invention is also achieved by means of a device for manufacturing a cutting insert green body by compacting a powder, said device comprising:

a first punch, a second punch that presents an abutment surface for abutment with the powder to be compacted, and an outer peripheral surface, and a punch edge at the intersection between the abutment surface and the outer peripheral surface, wherein the punch edge presents a predetermined curvature around the circumference of the second punch, a first die part, presenting a chamber having an inner peripheral surface which corresponds to a peripheral surface of a cutting insert green body to be compacted in said first die part, a bore for receiving said first punch, said bore extending from an opening in a first end surface of the first die part to said chamber, and an opening region extending with an expanding cross-section from said chamber to an opposite second end surface of the first die part and defining an opening in said opposite second end surface, a second die part, presenting a second bore for receiving said second punch, said bore extending from a an opening in the first end surface of the second die part to a second end surface thereof, thereby defining an opening in said second end surface, wherein an edge that defines said opening in the second end surface of the first die part has a curvature corresponding to the predetermined curvature of said punch edge of the second punch, the second end surface of the first die part being adapted to be arranged contiguously in relation to the second surface of the second die part such that said opening in the second end surface of the first die part meets said opening in the second end surface of the second die part, wherein, when the first and second die parts are arranged contiguously in relation to each other in connection to filling of powder into the die, one of said first and second die parts is arranged above the other die part, wherein said first end surface of the one of the first and second die parts being arranged above the other die part extends rectilinearly in at least in one direction, said device being characterized in that said predetermined curvature is at least partly non-perpendicular to a pressing axis of the device and that the edge of the opening in the second end surface of the first die part presents a corresponding curvature with regard to said pressing axis, and that when the device is in a position ready for filling of powder into the die, it presents a cavity defined by the one of the first and second die parts being arranged below the other die part, a punch introduced therein and the one of the first and second die parts being arranged above the other die part. Thereby, the opening in the first end surface of the one of the first and second die parts being arranged above the other die part is exposed for enabling filling of powder into said cavity through said opening.

Since the first end surface of the one of the first and second die parts being arranged above the other die part extends rectilinearly in at least one direction, said first end surface can be used for advancing a powder-filling device to and from a powder filling position on top of the opening therein by means of a sliding motion in the direction in which the first end surface extends rectilinearly. The punch that is introduced into the one of the first and second die parts being arranged below the other die part and contributes to the definition of said cavity when the device is in a position ready for filling of powder is the punch associated to the die part that forms the lower die part. Thus if the one of the first and second die parts being arranged below the other die part is the first die part, the punch introduced therein, from below, is the first punch. If the one of the first and second die parts being arranged below the other die part is the second die part, the punch introduced therein, from below, is the second punch.

According to one embodiment of the device of the invention the first end surface of the upper die part is flat. Thereby, a powder-filling device is not restricted to slide along a specific direction on said first end surface of the one of the first and second die parts being arranged above the other die part, but can be slid in any direction thereon to or from the opening in said first end surface.

Preferably, the first surface of the one of the first and second die parts being arranged above the other die part extends in a plane perpendicular to the pressing axis. Preferably, the pressing axis extends in a vertical direction.

According to one embodiment the device comprises a powder-filling device, arranged to slide on said first end surface of the one of the first and second die parts being arranged above the other die part in said least one direction in which the first end surface extends rectilinearly, to and from a powder-filling position on top of said opening in the first end surface of the one of the first and second die parts being arranged above the other die part.

According to one embodiment the second punch is arranged so as to be advanced through the second die part to a final compaction position at which the punch edge is at a distance so short from the inner peripheral surface of said chamber of the first die part that, upon compaction of a powder introduced into said cavity, an edge of the compacted green body will be formed in the region in which said punch edge is adjacent to said inner peripheral surface. The punch is however arranged so as not to contact the inner peripheral surface of the chamber of the first die with its punch edge, but to leave a small gap to the latter. Preferably, said edge of the compacted green body corresponds to the cutting edge of a cutting insert produced from said compacted green body.

According to one embodiment, the second punch is arranged to be advanced until the distance between the punch edge and the inner peripheral surface of said chamber is equal to or less than 50 μm, preferably equal to or less than 30 μm, even more preferably equal to or less than 10 μm, or even more preferably equal to or less than 5 μm.

Preferably, when the second punch is in its final compaction position, the distance L in the direction of the pressing axis from the level of the punch edge to the level of the edge that defines the opening in the second surface of the first die part is within the range of 1-500 μm, preferably within the range of 100-300 μm. The lower limit is dependent on the depth of the chamber, i.e. the height of the green body to be compacted. Preferably $L \geq 10$ μm, and it may be preferred that $L \geq 50$ μm. The green body will expand once the second punch (and possibly also the second die) is retracted from the green body, and it is desired that the green body does not expand beyond the edge that defines the opening of first die. Therefore, said distance must not be too short, and is related to the height of the green body and the expected expansion of the latter. The upper limit is chosen with regard to the fact that it is desired that the release portion along which the green body is taken out of the first die should be as short as possible in order to minimize the upcoming of damages on the green body caused by contact between the green body and the inner peripheral surface of in the region of the opening in the second end surface in the first die part and/or by loose powder and residual edge remain on the inner peripheral surface of the opening region of the first die part. Preferably, the distance between said levels is constant around the circumferences of the second punch and said opening in the second end surface of the first die part.

According to one embodiment of the device of the invention, a region around said opening in the second end surface of the second die part has a curvature corresponding to the curvature of the edge that defines the opening in the second surface of the first die part, such that the second surface of the second die part will be in sealing relation with said edge of the opening in the second end surface of the first die part when the first and second die parts are contiguously arranged.

According to another embodiment, when the first and second die parts are contiguously arranged, the second surface of the second die part overlaps the opening in the second surface of the first part, thereby forming an overlapping rim around said opening in the second end surface of the first die part. The width of the rim is dependent of the angle of the inner periphery of the chamber of the first die part and the angle of the inner periphery in the before-mentioned opening region of the first die part (that forms a release portion for the green body), as well as the distance in the direction of the pressing axis between the level of the punch edge of the second punch and the level of the edge that defines the opening in the second end surface in the first die part (when the second punch is in its final compaction position), and the width of the second punch. Preferably, at least in the region of the opening in the second end surface of the second die part the bore therein is of a dimension (width) such that there is only a very small gap between the inner periphery of the bore in the second die part and the outer peripheral surface of the second punch. The bore in the second die part may thereby contribute to a guiding and lateral positioning of the second punch.

According to one embodiment of the device of the invention, the die comprises an outer die part that at least partially laterally encloses the first and second die parts when those are joined, and wherein the outer die part has an upper surface that, at least partially (at the conceived path of a powder-filling device), coincides with the first surface of the one of the first and second die parts being arranged above the other die part when the latter is joined with said other die part and the device is in a position ready for filling of powder into said cavity. The outer die part may be connected to, and form a single unit with, the one of the first and second die parts being arranged below the other die part. The outer die part may also be regarded as a table, providing a further support surface for a powder filling-device. Thanks to the provision of its upper surface such that it at least partially coincides with the first end surface of the one of the first and second die parts being arranged above the other die part, sliding of and positioning of a powder-filling device on said upper surface is enabled.

According to yet another embodiment of the device of the invention, said one of the first and second die parts being arranged above the other die part presents an extension that laterally overlaps the one of the first and second die parts being arranged below the other die part when the first and second die parts are joined, wherein said extension comprises a lateral opening which is exposed when the one of the first and second die parts being arranged above the other die part is retracted from the position in which it is joined with said other die part, such that a compacted green body, which is exposed as a result of said retraction of the one of the first and second die parts being arranged above the other die part and a displacement of the green body out of the first die part in the direction of the pressing axis, is laterally exposed through said opening. The extension may comprise one or more shanks extending downwards from the upper die part, or a sleeve extending downwards from the one of the first and second die parts being arranged above the other die part. Preferably, said lower extension of the upper die part is connected to an actuator arranged to displace the one of the first and second die parts being arranged above the other die part in the direction of the pressing axis. In this embodiment, the actuator for displacing the one of the first and second die parts being arranged above the other die part is thus arranged below the die.

Alternatively, the die part forming the one of the first and second die parts being arranged above the other die part presents an upper extension which extends above said first surface of the upper die part. Preferably, said upper extension of the one of the first and second die parts being arranged above the other die part is connected to an actuator arranged to displace the one of the first and second die parts being arranged above the other die part in the direction of the pressing axis. In such an alternative embodiment, the actuator for displacing the one of the first and second die parts being arranged above the other die part is thus arranged above the die. The upper extension must enable the powder-filling device to slide to and from its powder-filling position on the one of the first and second die parts being arranged above the other die part.

According to one embodiment of the device of the invention, the cutting insert green body to be compressed has the shape of a positive cutting insert, and the inner peripheral surface of said chamber in the first die part has a corresponding shape, with a cross section cross wise to the pressing axis that increases towards the opening in the second surface of the first die part. A positive cutting insert may be referred to as a cutting insert the cross section of which increases from a first end thereof to second end thereof, wherein said second end carries a cutting edge of the cutting insert. According to alternative embodiments of the invention, the cutting insert, and thereby the inner peripheral surface of said chamber of the first die part, may define a double positive cutting insert, i.e. a shape that has a waist between its opposite ends, such that the first die part must be subdivided in subparts that are separable in a direction cross-wise to the pressing axis in order to enable exposal of the compacted green body and removal thereof from the die.

According to one embodiment the second die part is one of the first and second die parts being arranged above the other die part. Thereby, after removal of the second die part from the first die part, the compacted green body is exposed as it is displaced upwards relative the first die part. Such displacement of the compacted green body relative the first die part may be achieved either by displacing the first die part downwards by the action of an actuator connected thereto and/or displacing the compacted green body upwards by the action of the lower (first) punch, which is in its turn connected to an actuator for the displacement thereof in the direction of the pressing axis.

According to an alternative embodiment, the first die part is the one of the first and second die parts being arranged above the other die part. Displacement of the compacted green part out of the first die part is then achieved either by displacing the first die part upwards by the action of an actuator connected thereto and/or by displacing the compacted green body downwards by displacing the upper punch, the lower (second) punch and the lower die part downwards by the action of actuators connected thereto. Which solution is chosen is a matter of design within the expected knowledge of the person skilled in the art.

The present invention also refers to a cutting insert, characterized in that it is formed from a green body produced in a device according to the invention and/or by means of a method according to the invention. Likewise, the invention also refers to a cutting insert green body produced in a device according to the invention or by means of a method according to the invention.

Further features and advantages of the present invention will be presented in the following detailed description of exemplifying embodiments of the invention.

BRIEF DESCRIPTION OF THE DRAWINGS

Hereinafter, embodiments of the present invention will be described in detail with reference to the annexed drawing, on which.

DETAILED DESCRIPTION OF THE INVENTION

Figure 1A:
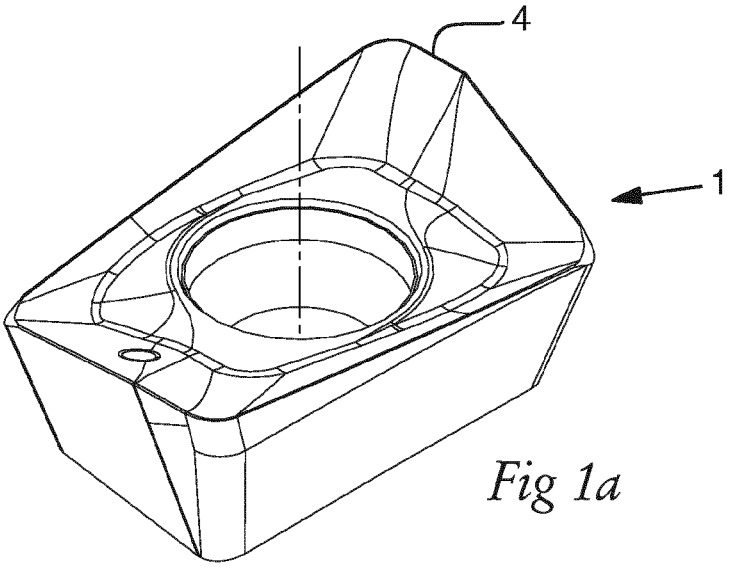
FIG. 1*a*-1*b* is a representation of a cutting insert the shape of which corresponds to a shape of a cutting insert green body to be produced in a device and by means of a method according to the present invention.
Figure 1B:
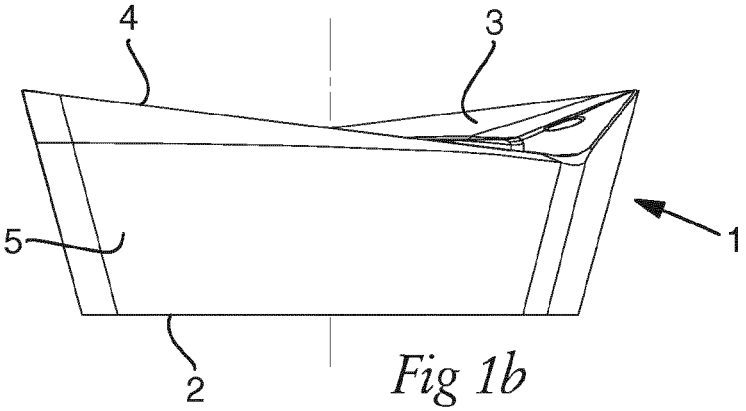

FIGS. 1*a* and 1*b* show a cutting insert green body 1 which could be produced by compaction of a powder by means of a device and a method according to the present invention. Typically, the cutting insert green body 1 is subjected to edge treatment and grinding followed by a sintering process in which it is further densified. In most cases, the sintered body is then provided with a suitable wear resistant coating, such as a carbide, nitride, carbonitride, oxide, or boride with any suitable contemporary technique, such as physical vapour deposition or chemical vapour deposition. The cutting insert is used for the machining of metal by milling, drilling or turning or by similar chip forming methods. The shape of the cutting insert corresponds to the shape of the compacted green body 1 from which it has been produced. What is hereby stated regarding the shape of the cutting insert green body 1 shown in FIGS. 1*a* and 1*b* is therefore also valid for the shape of a cutting insert produced from said green body.

The cutting insert green body 1 shown in FIGS. 1*a* and 1*b* has the shape of a positive cutting insert, presenting an increasing cross section from a first end 2 thereof, to a second end 3 thereof. At the second end 3 of the green body 1 the latter presents a cutting edge 4 which runs around the circumference of the green body 1. The cutting edge 4 is defined by an intersection of the surface of the second end 3 and a peripheral surface 5 of the green body 1. The edge 4 has a curvature that is at least partly non-perpendicular to an axis x corresponding to the pressing axis that has been applied during the compaction of a powder into said green body 1. Partly non-perpendicular is hereby referred to as having a curvature, such that, for different angular positions around said axis x along said cutting edge around the circumference of the green body 1, the position of the cutting edge in the direction of the pressing axis differs.

Figure 2A:
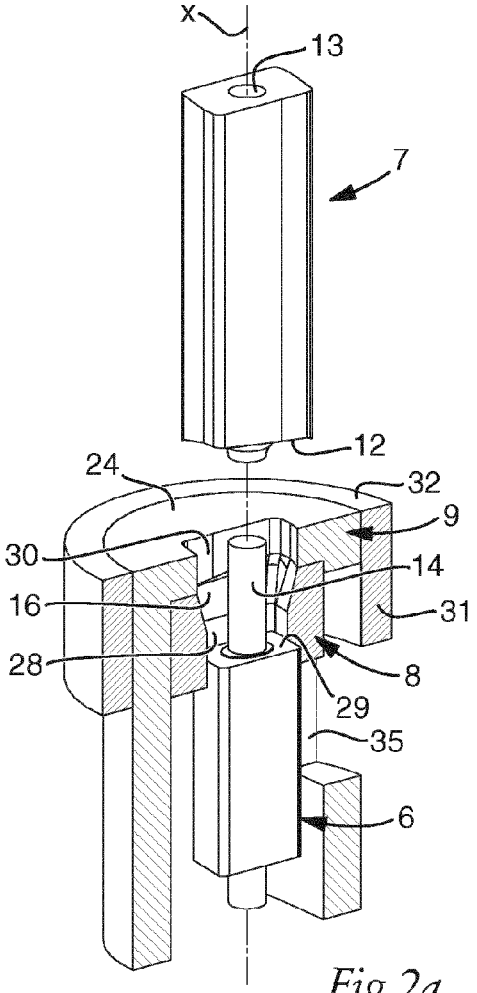
FIG. 2*a* is a perspective cross section of a first embodiment of a device according to the invention.
Figure 2B:
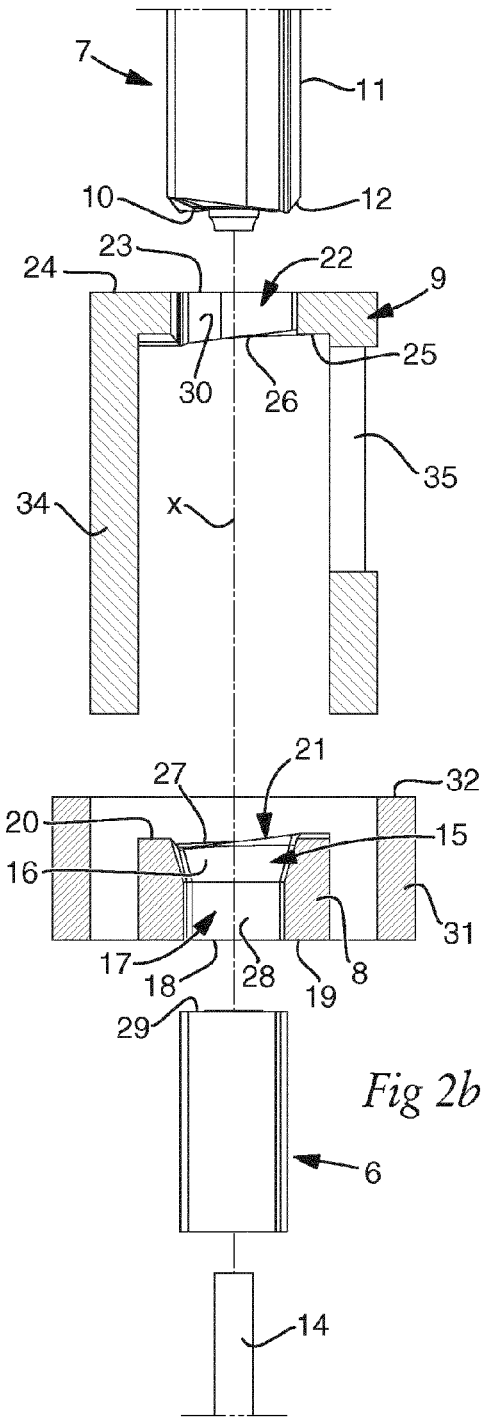
FIG. 2*b* is an exploded side view of a cross section of the embodiment shown in FIG. 2*a*.

FIG. 2 shows a first embodiment of a device according to the present invention for producing a cutting insert green body like the green body 1 shown in FIGS. 1*a* and 1*b*. The device defines a press tool that comprises a first punch 6, a second punch 7, a first die part 8 and a second die part 9. It should be understood that parts of the device that are to be displaced during the operation of the device may be connected to actuators provided for that purpose. Such actuators, and the specific connection of said parts thereto, are not shown in the drawing, since it is regarded as ordinary design measures to be taken by a person skilled in the art.

The second punch 7 presents an abutment surface 10 for abutment with the powder to be compacted, and an outer peripheral surface 11, and a punch edge 12 at the intersection between the abutment surface 10 and the outer peripheral surface 11, wherein the punch edge 12 presents a predetermined curvature corresponding to the curvature of the abovementioned cutting edge of the green body 1. Accordingly, the punch edge 12 presents a curvature that is at least partly non-perpendicular to the pressing axis x in the sense that it has a curvature, such that, for different angular positions along said cutting edge around the circumference of the green body 1, the position of the cutting edge in the direction of the pressing axis differs.

The second punch 7 also presents a centre bore 13 extending in the longitudinal direction of punch 7, i.e. parallel with the pressing axis x, for the purpose of receiving a core pin 14. It should however be understood that the provision of a core pin and bores like the bore 13 in the second punch 7 is optional and not critical to the present invention.

The first die part 8 presents a chamber 15, with an inner peripheral surface 16 which has a geometry that corresponds to the geometry of the peripheral surface 5 of the cutting insert green body 1 to be compacted in said first die part 8. Furthermore, the first die part 8 presents a bore 17 for receiving said first punch 6, said bore 17 extending from an opening 18 in a first end surface 19 of the first die part 8 to said chamber 15, and an opening region extending with an expanding cross-section from said chamber 15 to an opposite second end surface 20 of the first die part 8 and defining an opening 21 in said opposite second end surface 20.

The second die part 9 presents a bore 22 for receiving said second punch 7. The bore 22 extends from an opening 23 in a first end surface 24 of the second die part 9 to a second end surface 25 thereof, thereby defining an opening 26 in said second end surface 25.

An edge 27 that defines said opening 21 in the second end surface 20 of the first die part 8 has a curvature corresponding to the predetermined curvature of the abovementioned punch edge 12 of the second punch 7 in the sense that it has a corresponding curvature around the circumference of the opening 21 that it defines as has the punch edge 12 around the circumference of the second punch 7. Curvature may be referred to as a variation of the position for each incremental part of the edge 27 in the direction of the pressing axis x.

FIG. 2*a* shows a first embodiment of the press tool of the present invention in a position ready for filling of powder into a cavity defined therein. The second end surface 20 of the first die part 8 is contiguously arranged in relation to the second end surface 25 of the second die part 9 such that said opening 21 in the second end surface 20 of the first die part 8 meets said opening 26 in the second end surface 25 of the second die part 9.

When the first and second die parts 8, 9 are contiguously arranged in relation to each other in connection to the filling of powder into the die, one of said first and second die parts 8, 9 is above the other, thereby defining an upper die part having its first end surface turned upwards. In the first embodiment shown in FIGS. 2-3, the second die part 9 is above the first die part 8. The first end surface 24 of the second die part 9 thus forms an upper surface of the die and the opening 23 defines an upper opening of the die, through which a powder to be compacted may be introduced into said cavity, which is defined by the inner peripheral surface 16 of said chamber 15 of the first die part 8, an inner peripheral surface 28 of the bore 17 of the first die part 8, an end surface 29 of the first punch 6 introduced into said bore 17, and an inner peripheral surface 30 of the bore 22 in the second die part 9.

The first end surface 24 of the second die part 9 is essentially flat and extends in a plane perpendicular to the pressing axis x. Preferably, the pressing axis x is vertical, and thus said plane is preferably horizontal.

The die further comprises an outer die part 31 that laterally encloses the first and second die parts 8, 9 when those are joined. The outer die part 31 may be connected to, and form a unit together with, the lower die part. The outer die part 31 has an upper surface 32 that coincides with the first surface 24 of the second die part 9 when the latter is joined with the first die part 8 and the device is in a position ready for filling of powder into said cavity. The outer die part 31 may be provided primarily for the purpose of defining a table on which a powder-filling device may be positioned during operation of the device. However, it may also have possible further function, such as stabilizing function, and may therefore be referred to as a die part, such as when being connected to the lower die part.

Figure 3A:
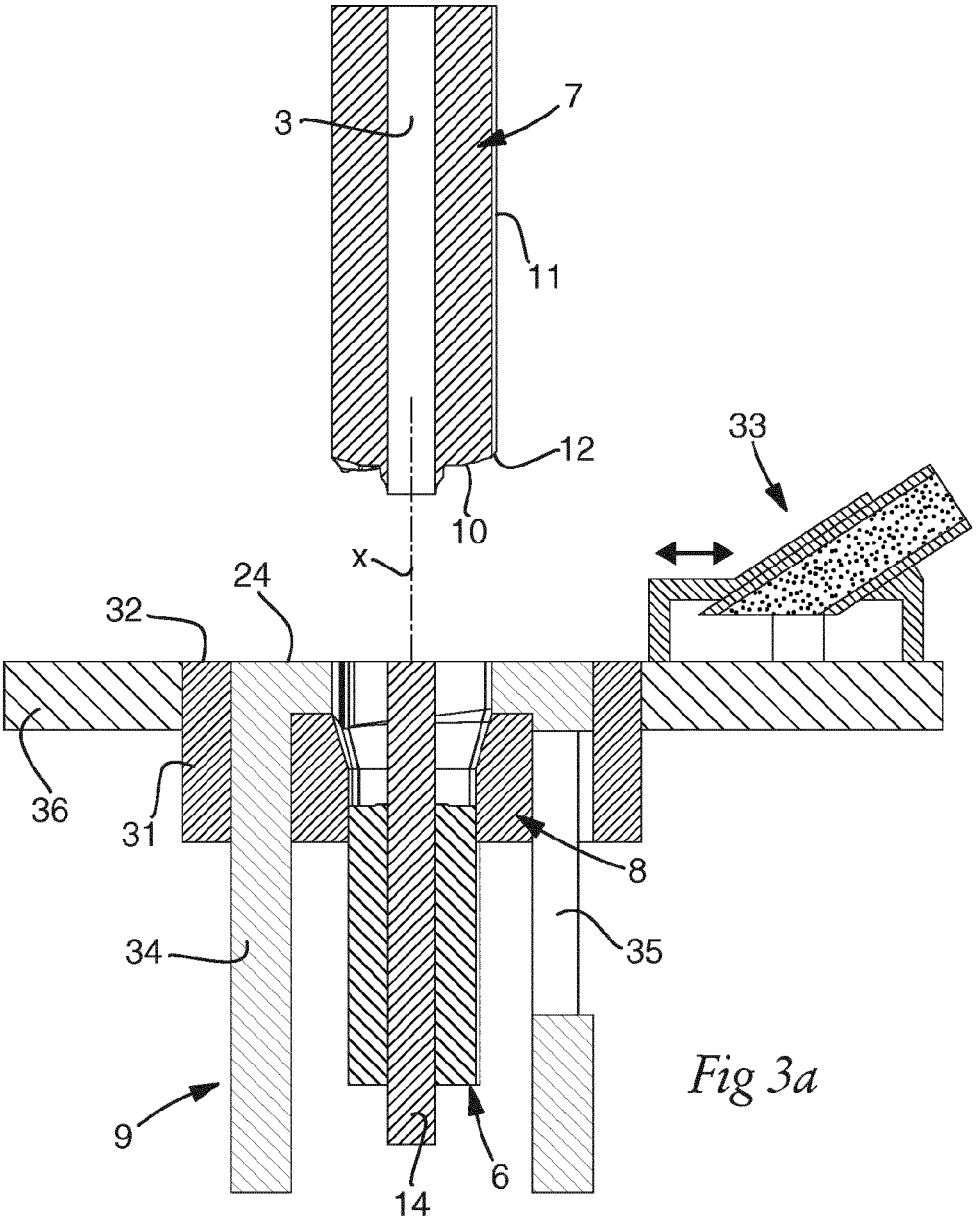
FIGS. 3*a*-3*g* is a series of figures showing the succeeding steps of the method according to an embodiment of the present invention for compacting a cutting insert green body by means of the abovementioned first embodiment of a compaction device according to the present invention, as seen in cross-section.
Figure 3B:
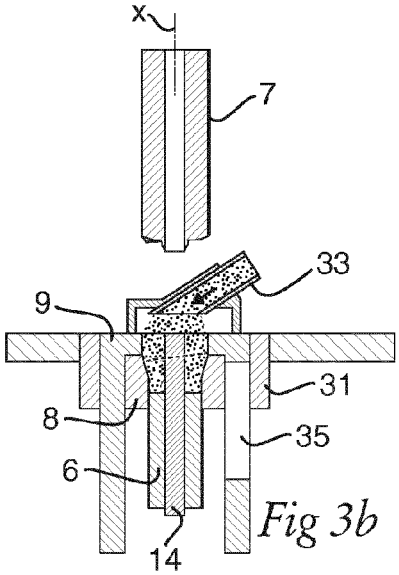
Figure 3C:
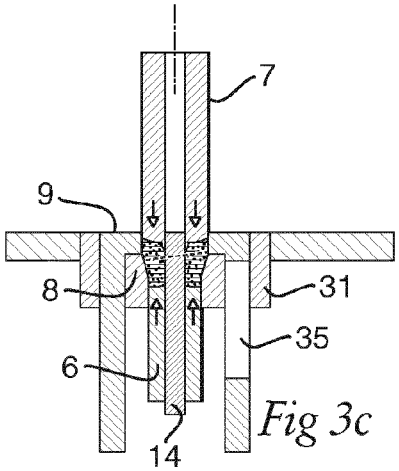
Figure 3D:
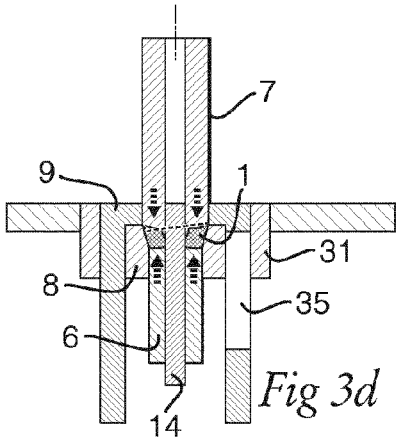
Figure 3E:
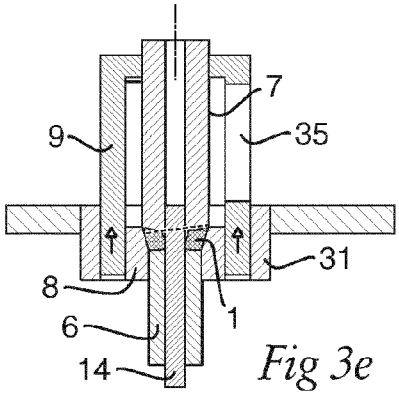
Figure 3F:
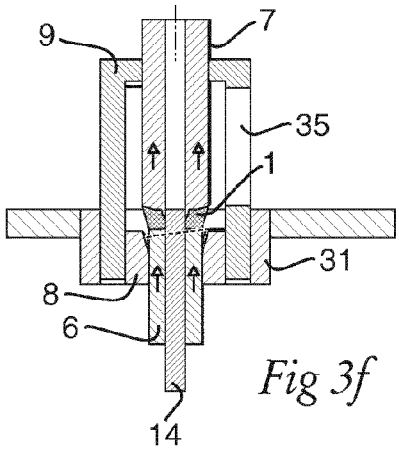
Figure 3G:
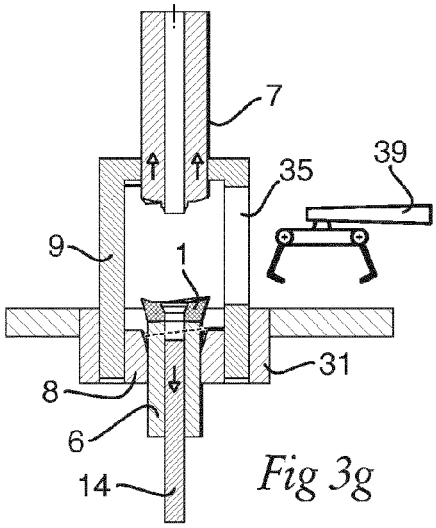

The second die part 9, presents an extension 34 that laterally overlaps the first die part 8 when the first and second die parts are joined and that comprises a lateral opening 35 which is exposed when the first and second die parts 8, 9 are retracted from each other, such that a compacted green body, which is exposed as a result of said retraction and a displacement of the green body out of the first die part 8 in the direction of the pressing axis x, is laterally exposed through said opening 35 (see in particular FIG. 3*g*). The extension 34 is in its turn connected to an actuator, not shown, located below the first die part 8. Other alternative solutions are of course feasible. According to one such alternative solution, not shown on drawing but within the scope of the present invention, the die part forming the upper die part presents an upper extension which extends above said first surface of the upper die part. Such an upper extension is connected to an actuator provided for the displacement thereof located above the die.

FIGS. 3*a*-3*g* show essential steps of an embodiment of the method of the invention applied by means of the above-disclosed first embodiment of the device according to the present invention.

FIG. 3*a* shows the device of the invention in a position ready for filling powder into the previously mentioned die cavity defined by the aforementioned peripheral surfaces 16, 28 and 30 and the end surface 29 of the first punch 6. The second punch 7 is retracted to a position above the first surface 24 of the second die part 9, leaving room for a powder-filling device 33 to be positioned on top of the opening 23 in the first end surface 24 of the second die part 9. The powder-filling device 33 may be regarded as forming part of the device of the invention. A further table 36 that laterally surrounds the outer die part 31 and has an upper surface in alignment with the upper surface 32 of the outer die part 31 is also shown and forms an optional part of the device.

FIG. 3*b* shows a subsequent step in which the powder-filling device 33 is positioned on top of the opening 23 in the first end surface 24 of the second die part and executes the filling operation. In order to move the powder-filling device 33 from the laterally retracted position shown in FIG. 3*a* to the position on top of said opening 23 shown in FIG. 3*b*, the powder-filling device 33 is slid on the first end surface of the upper die part, i.e. the first end surface 24 of the second die part 9, and here also on the upper surface 32 of the outer die part 31 and the upper surface of the surrounding table 36. The first punch 6 is in a position inside the bore 17 of the first die part 8, but somewhat retracted in relation to the chamber 15 therein in order to enable receipt of a sufficient amount of powder in the cavity thereby defined in the die.

FIG. 3*c* shows a subsequent compaction step in which the second punch 7, is being displaced downwards into the bore 22 in the second die part 9. The first punch 6 is displaced upwards through the bore 17 towards the chamber 15 in the first die part 8. Preferably, but not necessarily, the displacements of the first punch 6 and the second punch 7 are simultaneous.

FIG. 3*d* shows the device in a final compaction position, in which the chamber 15 that defines the geometry of the cutting insert green body 1 to be formed is now defined by the inner peripheral surface 16 of the chamber 15 of the first die part, the upper end surface 29 of the first punch 6 and the abutment surface 10 of the second punch 7. Here, the method according to the invention comprises the step of compacting the powder introduced into said cavity by advancing the second punch 7 through the second die part 9 until the punch edge 12 is at a distance from said inner peripheral surface 16 of said chamber 15 of the first die part 8 so short that an edge, corresponding to a cutting edge of the cutting insert, of the compacted green body 1 will be formed in the region in which said punch edge 12 is adjacent to said inner peripheral surface 16.

Figure 6:
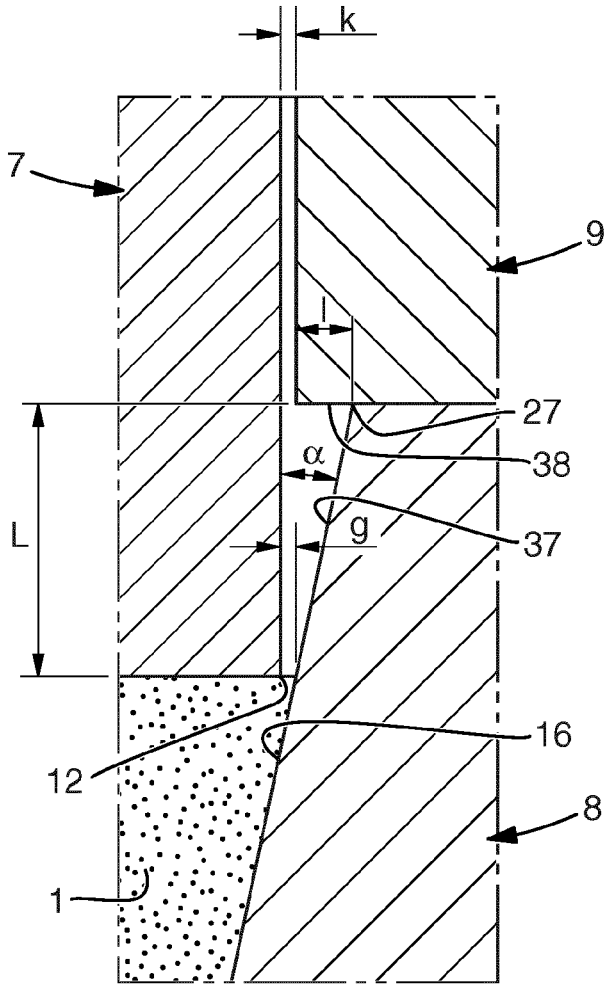
FIG. 6 is an enlarged representation of a detail of the an inventive device showing some essential parts of the device in a final compaction position of a second punch.

Reference is now being made to FIG. 6 that shows a detail of the device in an enlarged scale in a position corresponding to the one shown in FIG. 3*d*. In the final compaction position, the second punch 7 protrudes with the punch edge 12 a distance L into the first die part 8, such that the distance g between the punch edge 12 and the inner peripheral surface 16 of the chamber 15 is equal to or less than 10 μm, or even more preferably equal to or less than 5 μm (anywhere around the circumference of the second punch 7). Since the edge 27 defining the opening 21 in the second end surface 20 of the first die part 8 has a curvature corresponding to the curvature of the punch edge 12, the distance between the punch edge 12 and said edge 27 is more or less the same all around the circumference of the second punch 7. The distance L in the direction of the pressing axis x from the level of the punch edge 12 to the level of the edge 27 that defines the opening 21 in the second surface 20 of the first die part 8 is within the range of 1-500 μm, preferably within the range of 100-300 μm. Preferably, L≥10 μm, and, depending on the geometry and size of the compacted body to be formed L≥50 μm. Powder is to a high degree prevented from escaping through the gap g between the punch edge 12 and the inner peripheral surface 16 of the chamber 15 and there will be a very limited space in which escaped loose powder can be gathered. Thereby, the invention results in an advantageous suppression of any formation of a residual edge on the cutting insert green body 1, and a promotion of a production of a cutting insert with a cutting edge with a very small radius.

From the level of the punch edge 12 to the level of the edge 27 defining the opening 21 in the second end surface 20 of the first die part 8, the inner peripheral surface 37 of the first die part 8 has an inclination angle α relative the pressing axis x which depends on the inclination angle of the inner peripheral surface 16 of the chamber 15. Preferably, the inclination angle α is the same for the inner peripheral surface 16 of the chamber 15 and the inner peripheral surface 37 of the opening region as seen at any cross section around in the circumference of the chamber 15. The inclination angle α may vary around the circumference of the inner peripheral surface 37 of the opening region and the inner peripheral surface 16 of chamber.

A region around the opening 26 in the second end surface 25 of the second die part 9 has a shape, i.e. a curvature around the circumference of said opening 26, corresponding to the curvature of the edge 27 that defines the opening 21 in the second surface 20 of the first die part 8, such that the second surface 25 of the second die part 9 will be in sealing relation with said edge 27 of the opening 21 in the second end surface 20 of the first die part 8 when the first and second die parts 8, 9 are joined. Thereby, powder is prevented from escaping into any possible space between the second surfaces 20, 25 of the first and second die parts 8, 9.

When the first and second die parts 8, 9 are contiguously arranged in relation to each other, the second surface 25 of the second die part 9 overlaps the opening 21 in the second end surface 20 of the first die part 8, thereby forming an overlapping rim 38 around said opening 21 in said second end surface 20 of the first die part 8. The size of the rim 38 may vary around the circumference of the opening 21 in the second end surface 20 of the first die part 8, depending on the geometry of the cutting insert green body 1 to be compacted and the geometry of said opening 21. The size of the rim 38 thus depends on the distance L that the punch edge 12 of the second punch 7 projects into the first die part 8, the inclination angle α and the gap k between the outer peripheral surface 11 of the second punch 7 and an inner peripheral surface 30 of the bore 22 in the second die part 9.

FIG. 3*e* shows a subsequent step in which the first and second die parts 8, 9 are separated from each other. In this particular embodiment, separation is achieved by means of retraction of the second die part 9 from the first die part 8. However, it should be understood that this is a relative displacement, and that the separation could as well be achieved by a displacement of the first die part 8 or both die parts. This is only a matter of connecting the respective part to an actuator, and thereby making displacement thereof possible.

FIG. 3*f* shows a subsequent step in which the first punch 6 and the second punch 7 are displaced in the direction of the pressing axis x relative the first die part 8 such that the compacted cutting insert green body 1 is displaced out of the first die part 8 through the opening 21 in the second end surface 20 of the first die part 8 and is exposed and laterally accessible through the opening 35 in the extension 34 of the second die part 9.

FIG. 3*g* shows a further step according to which the punch that forms the upper punch, here the second punch 7, is further retracted as well as the core pin 14, such that the exposed cutting insert green body 1 is only supported by an upper end surface of the lower punch, here the first punch 6. The exposed cutting insert green body 1 can now get gripped by a device 39 for the removal of the green body 1 from the die. The removal device 39 may be any kind of robot or the like.

Figure 4A:
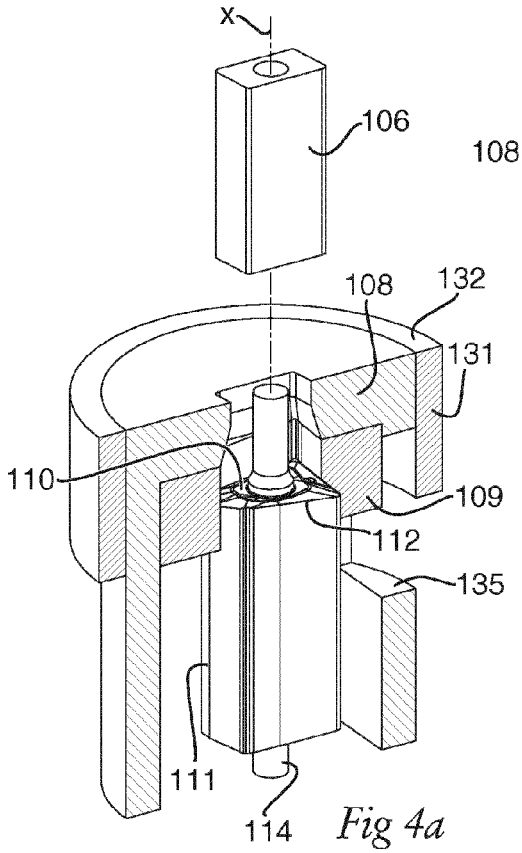
FIG. 4*a* is a perspective cross section of a second embodiment of the device according to the invention.
Figure 4B:
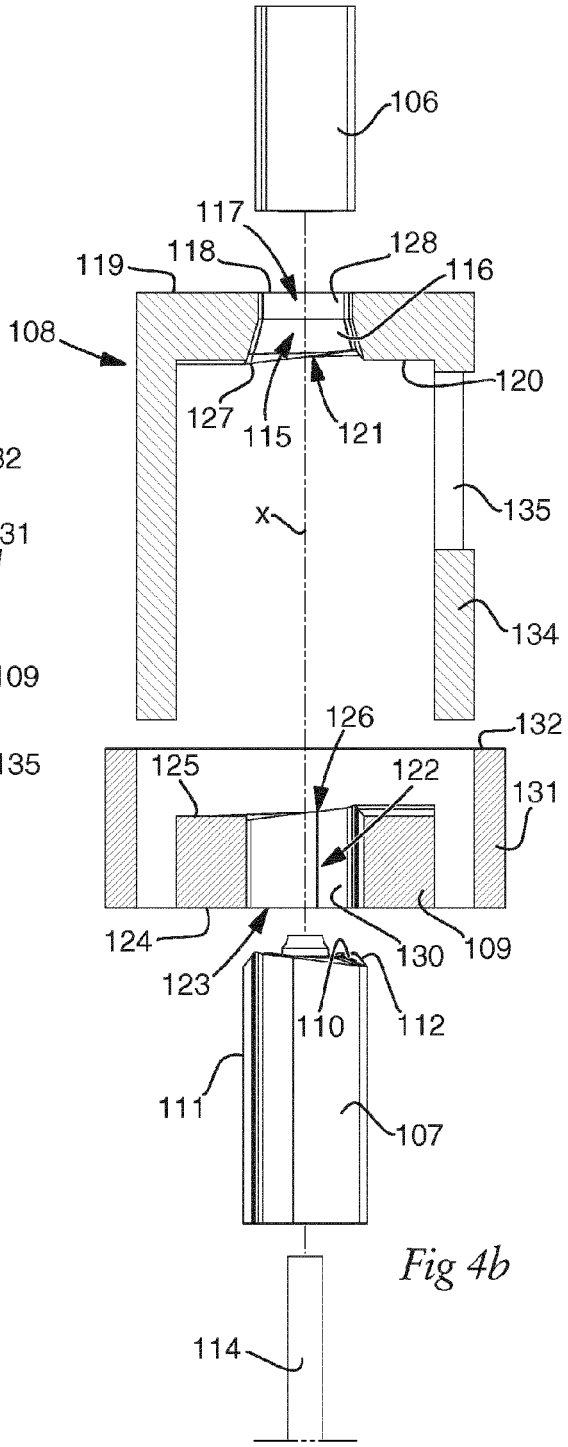
FIG. 4*b* is an exploded side view of a cross section of the embodiment shown in FIG. 4*a*.

FIG. 4 shows an alternative embodiment which differs from the first embodiment in the sense that the first die part 108 is positioned above the second die part 109, thereby defining an upper die part having its first end surface 119 turned upwards. The first punch 106 and the second punch 107 are identical to the ones disclosed with reference to the first embodiment. Thus, the second punch 107 has an abutment surface 110, a peripheral surface 111 and a punch edge 112. The first die part 108 presents a chamber 115 with an inner peripheral surface 116, a bore 117 extending from the chamber 115 to an opening 118 in a first end surface 119, an opening region extending from the chamber 115 to an opening 121 in an opposite second end surface 120, said opening being defined by an edge 127. The second die part 109 presents a bore 122 which extends from an opening 123 in first end surface 124 to an opening 126 in an opposite second end surface 125. What has previously been stated regarding the provision of the corresponding surfaces, openings, bores, extensions and actuators of the first embodiment is also valid for these surfaces, openings, bores, extensions and actuators in the second embodiment.

The embodiment in FIG. 4 further differs from the one shown in FIGS. 2 and 3 in that it is the first die part 108 that comprises an extension 134 corresponding to the extension 34 carried by the second die part 9 in the first embodiment. Accordingly, also here it is the upper die part that presents said extension. However, it should be mentioned that, as an alternative to the design presented in both the abovementioned embodiments, the extension may be provided on the lower die part, provided that the upper die part is designed such that it still enables the filling of powder into the latter from a position on top thereof and removal of the compacted green body by, for example, a robot. The provision of extensions that connect the respective moving part with an actuator is a matter of choice with regard to the requested functionality, and may be varied widely within the scope of the present invention.

When the die is in a position ready for filling of powder, the second end surface 120 of the first die part 108 is contiguously arranged in relation to the second end surface 125 of the second die part 109 such that the opening 121 in the first die part 108 meets the opening 126 in the second die part 109. A cavity is defined by inner peripheral surfaces 116, 128, 130 of the above-mentioned bores and chamber and the abutment surface 110 of the second punch 107, which projects from below into the bore provided in the second die part 109. The first end surface 119 of the first die part 108 forms a flat upper surface in which the abovementioned opening 118 is provided. An outer die part 131, that may or may not be directly connected to the lower die part, surrounds the first and second die parts 108, 109 laterally and presents an upper surface 132 which coincides with and is in alignment with the first end surface 119 of the first die part 108. A powder-filling device 133 is provided for the purpose of filling powder into said cavity through said opening 118 in the first end surface 119 of the first die part 108 from a position on top of said opening 118. The powder-filling device 133 reaches its operative position above the opening 118 by sliding on the first end surface 119 of the first die part 108 and on the upper surface 132 of the outer die part 131.

FIGS. 5*a*-5*f* show essential steps of an embodiment of the method of the invention applied by means of the above-disclosed second embodiment of the device according to the present invention.

Figure 5A:
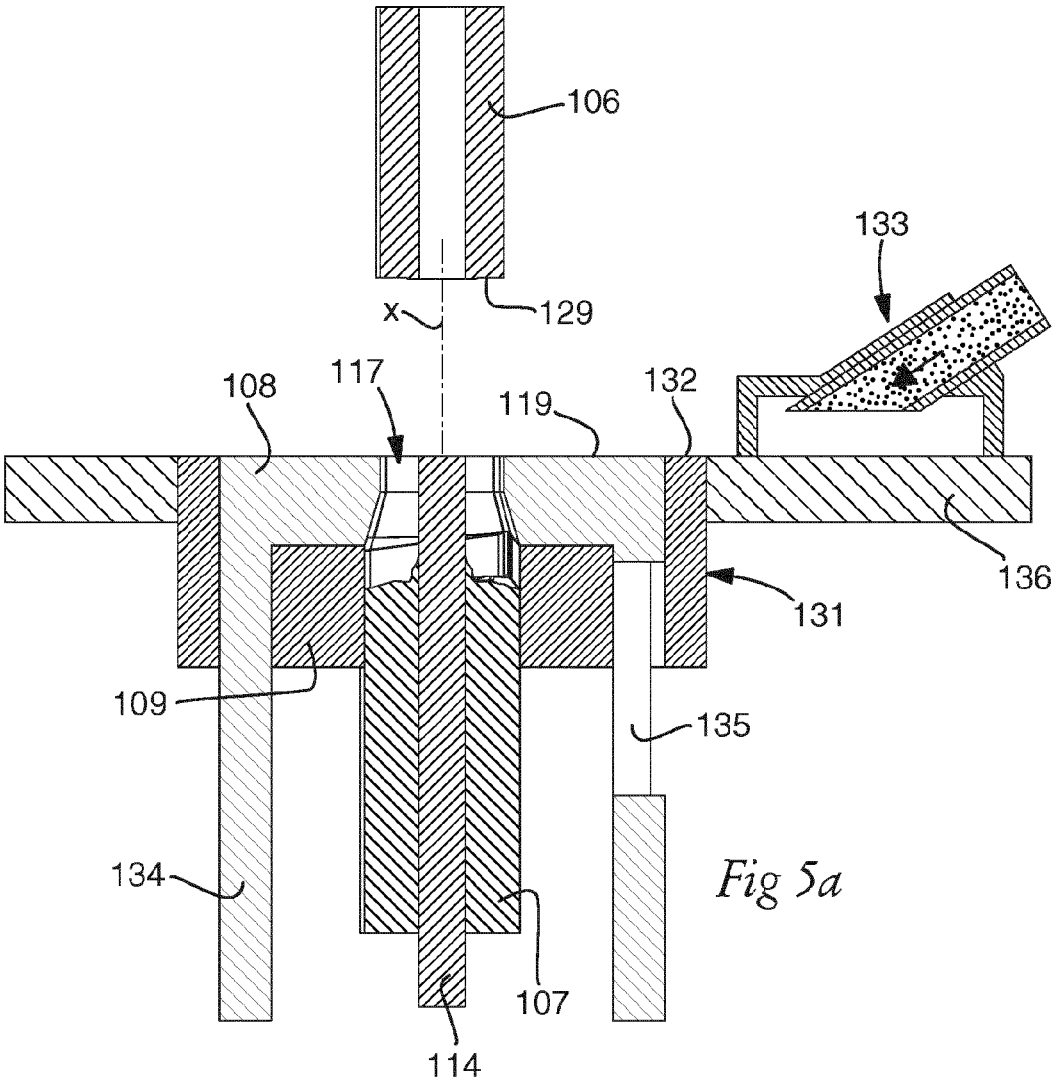
FIGS. 5*a*-5*f* is a series of figures showing the succeeding steps of the method according to an embodiment of the present invention for compacting a cutting insert green body by means of the abovementioned second embodiment of a compaction device according to the present invention, as seen in cross-section.

FIG. 5*a* shows the device in a position ready for filling of powder into the cavity defined by the inner peripheral surfaces 116, 128, 130 of the chamber 115, the bore 117 and the bore 122 and the abutment surface 110 of the second punch 107. A further table 136 that laterally surrounds the outer die part 131 and has an upper surface in alignment with the upper surface 132 of the outer die part 131 is also shown and forms an optional part of the device. The powder-filling device 133 is located on the upper surface of the table 136 and is ready for sliding on that surface and the upper surface 132 of the outer die part 131 and the first end surface 119 of the first die part 108 to a position on top of said opening 118 in said first end surface 119. The first punch 106 is retracted from the first end surface 119 of the first die part 108 in order to enable the positioning of the powder-filling device 133 on top of said opening.

Figure 5B:
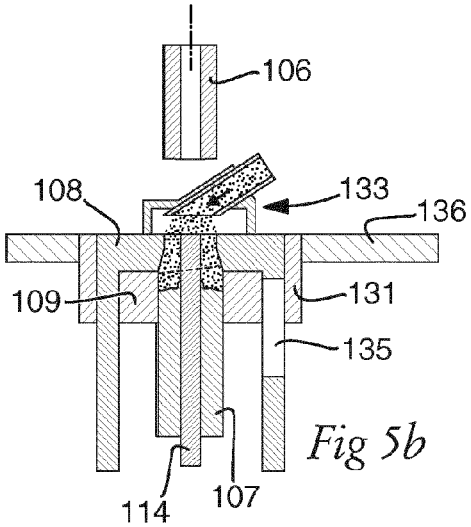

FIG. 5*b* shows a subsequent step in which the powder-filling device 133 fills the abovementioned cavity with powder. The second punch 107 is in a position inside the bore 122 of the second die part 109, but somewhat retracted in relation to the chamber 115 therein in order to enable receipt of a sufficient amount of powder in the cavity thereby defined in the die. As an alternative, the second punch 107 could be in its final compaction position already at this stage, provided that the cavity defined by the die is yet large enough to accommodate the required amount of powder.

Figure 5C:
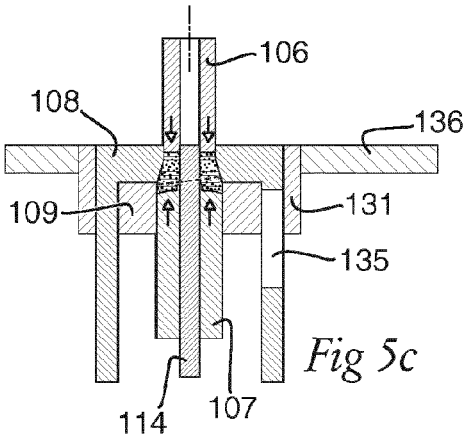

FIG. 5*c* shows a subsequent compaction step in which the first punch 106, is being displaced downwards into the bore 117 in the first die part 108. The second punch 107 is displaced upwards through the bore 122 in the second die part 109 towards the chamber 115 in the first die part 108. Preferably, but not necessarily, the displacements of the first punch 106 and the second punch 107 are simultaneous.

Figure 5D:
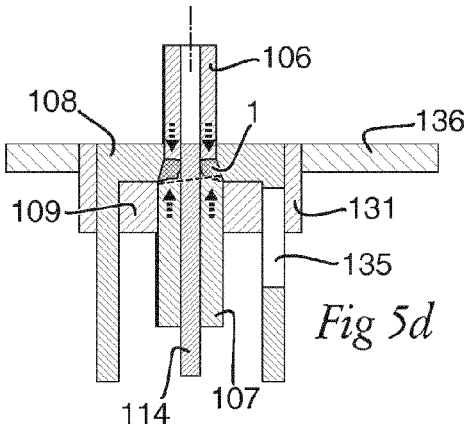
Figure 5E:
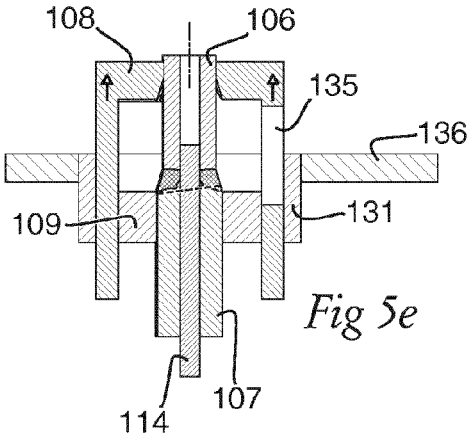

FIG. 5*d* shows the device in a final compaction position, in which the chamber 115 that defines the geometry of the cutting insert green body 1 to be formed is now defined by the inner peripheral surface 116 of the chamber 115 of the first die part, the end surface 129 of the first punch 106 and the abutment surface 110 of the second punch 107. Likewise to the first embodiment disclosed with reference to FIG. 3*a*-3*g*, the method according to the second embodiment of the invention comprises the step of compacting the powder introduced into said cavity by advancing the second punch 107 through the second die 109 and predetermined distance into the first die part 108 such that the punch edge 112 is at a distance from said inner peripheral surface 116 of said chamber 115 of the first die part 108 so short that an edge, corresponding to a cutting edge of the cutting insert, of the compacted green body 1 will be formed in the region in which said punch edge 112 is adjacent to said inner peripheral surface 116. In the region corresponding to the region shown in FIG. 6, the second embodiment preferably presents the same features as the first embodiment. However, FIG. 6 would have to be turned upside down to fully reflect the second embodiment presented in FIGS. 4-5.

Figure 5F:
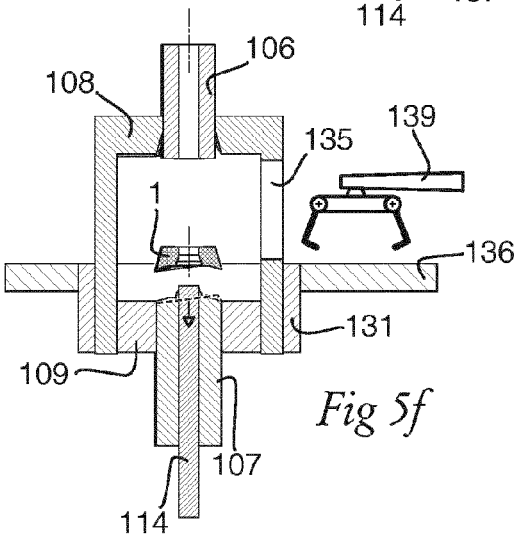

FIG. 5*f* shows a subsequent step in which the first die part 108 is retracted upwards relative the lower die part 109 in order to displace the compacted cutting insert green body 1 out of the first die part 108. A lateral opening 135 in the extension 134 of the first die part 108 makes the cutting insert green body accessible from a lateral position.

FIG. 5*g* shows a further step in which the first punch 106 is retracted upwards from the compacted cutting insert green body 1 and the core pin 114 is retracted downwards from said body 1 in order to enable removal of the compacted green body 1 from the die by means of a device 139 for the removal of the green body 1 from the die. The compacted green body 1 is thus only supported by the abutment surface 110 of the second punch 107 when being gripped by said device 139.

It should be understood that the above description of the invention is only by way of example and that the scope of protection is defined by the patent claims, and that alternative embodiments obvious to the person skilled in the art are included in the claimed scope of protection. Accordingly, the invention also includes solutions in which any of the abovementioned first and second die parts are further subdivided into two or more subparts. Furthermore, the first and second parts, though it is preferred in connection to the present invention, need not be separated from each other by displacement thereof in the direction of the pressing axis. If any such die part is subdivided into two or more subparts, such a die part may be removed from the other die part by separation of such subparts and displacement thereof in another direction than the pressing axis, such as in a direction perpendicular to the pressing axis. There may also be further punches, and subdivision of the abovementioned punches into several punches. Also the number of core pins is a matter of choice for the person skilled in the, as well as the connection of the respective die parts, punches and core pins to actuators for the displacement thereof.

The invention claimed is:

1. A method of compacting a powder into a cutting insert green body comprising the steps of:

providing a compaction device including a first punch; a second punch that presents an abutment surface for abutment with the powder to be compacted, an outer peripheral surface, and a punch edge disposed at an intersection between the abutment surface and the outer peripheral surface, wherein the punch edge presents a predetermined curvature around the circumference of the second punch; a first die part presenting a chamber having an inner peripheral surface which corresponds to a peripheral surface of a cutting insert green body to be compacted in said first die part, a bore for receiving said first punch, said bore extending from an opening in a first end surface of the first die part to said chamber, and an opening region extending with an expanding cross-section from said chamber to an opposite second end surface of the first die part and defining an opening in said opposite second end surface; a second die part presenting a bore for receiving said second punch, said bore extending from an opening in a first end surface of the second die part to a second end surface thereof, thereby defining an opening in said second end surface, wherein an edge that defines said opening in the second end surface of the first die part has a curvature corresponding to the predetermined curvature of said punch edge of the second punch;

arranging the second end surface of the first die part and the second end surface of the second die part contiguously such that said opening in the second end surface of the first die part meets said opening of the second end surface of the second die part;

positioning the device such that one of said first and second die parts is contiguously arranged above the other die part;

arranging said first end surface of the one of the die parts being arranged above the other die part such that it extends rectilinearly in at least one direction;

introducing one of said punches into the bore of the one of the die parts being arranged below the other die part, wherein said predetermined curvature of the punch edge of the second punch is at least partly non-perpendicular to a pressing axis of the device and that the edge of the opening in the second end surface of the first die part presents a corresponding curvature with regard to said pressing axis; and filling powder into a cavity defined by the one of the die parts being arranged below the other die part, the punch introduced therein and the one of the die parts being arranged above the other die part by introducing the powder through the opening in the first end surface of the one of the die parts being arranged above the other die part; and compacting the powder.

2. A method according to claim 1, wherein the step of compacting the powder includes introducing into said cavity by advancing the other of said first and second punches through the opening in the first end surface of the one of the first and second die parts being arranged above the other die part towards said chamber to a final compacting position.

3. A method according to claim 1, wherein the step of compacting the powder includes introducing into said cavity by advancing the second punch through the second die part until the punch edge is at a distance from said inner peripheral surface of said chamber of the first die part so short that an edge of the compacted green body will be formed in the region in which said punch edge is adjacent to said inner peripheral surface.

4. A method according to claim 3, wherein the second punch is advanced until the distance between the punch edge and the inner peripheral surface of the chamber in the first die part is equal to or less than 50 μm, equal to or less than 30 μm, equal to or less than 10 μm, or equal to or less than 5 μm.

5. A method according to claim 1, further comprising the steps of exposing the compacted cutting insert green body by retracting the first die part from the second die part, and displacing the compacted green body from the first die part through the opening in the second end surface thereof.

6. A method according to claim 1, further comprising the step of providing a region around said opening in the second end surface of the second die part with a curvature corresponding to the curvature of the edge that defines the opening in the second end surface of the first die part, such that the second surface of the second die part will be in a sealing relation with said edge of the first die part when the first die part is contiguously arranged in relation to the second die part.

7. A method according to claim 1, further comprising the step of providing a powder-filling device and positioning it on top of said opening in the first end surface of the upper die part or removing it from said position by permitting it to slide on said first end surface of the upper die part in said direction in which said surface extends rectilinearly.

8. A method according to claim 1, wherein the compacted cutting insert green body has the shape of a positive cutting insert, and that the inner peripheral surface of said chamber in the first die part has a corresponding shape, with a cross section cross wise to the pressing axis that increases towards the opening in the second end surface of the first die part.

9. A device for manufacturing a cutting insert green body by compacting a powder, said device comprising:

a first punch;

a second punch that presents an abutment surface for abutment with the powder to be compacted, an outer peripheral surface, and a punch edge at an intersection between the abutment surface and the outer peripheral surface, wherein the punch edge presents a predetermined curvature around the circumference of the second punch;

a first die part, presenting a chamber having an inner peripheral surface which corresponds to a peripheral surface of a cutting insert green body to be compacted in said first die part, a bore for receiving said first punch, said bore extending from an opening a first end surface of the first die part to said chamber and an opening region extending with an expanding cross-section from said chamber to an opposite second end surface of the first die part and defining an opening in said opposite second end surface;

a second die part, presenting a bore for receiving said second punch, said bore extending from an opening in the first end surface of the second die part to a second end surface of the second die part, thereby defining an opening in said second end surface, wherein an edge that defines said opening in the second end surface of the first die part has a curvature corresponding to the predetermined curvature of said punch edge of the second punch, the second end surface of the first die part being configured to be contiguously arranged in relation to the second surface of the second die part such that said opening in the second end surface of the first die part meets said opening in the second end surface the second die part, wherein, when the first and second die parts are contiguously arranged to each other in connection to filling of powder into the die, one of said first and second die parts is arranged above the other, said first end surface of the one of the die parts being arranged above the other die part extends rectilinearly in at least in one direction, said predetermined curvature being at least partly non-perpendicular to a pressing axis of the device and that the edge of the opening in the second end surface of the first die part presents a corresponding curvature with regard to said pressing axis; and when the device is in a position ready for filling of powder into the die, it presents a cavity defined by the one of the die parts being arranged below the other die part, a punch being introduced therein and the one of the die parts being arranged above the other die part.

10. A device according to claim 9, wherein the first end surface of the one of the die parts being arranged above the other die part is flat.

11. A device according to claim 9, wherein the first surface of the one of the die parts being arranged above the other die part extends in a plane perpendicular to the pressing axis.

12. A device according to claim 9, further comprising a powder-filling device, arranged to slide on said first surface of the one of the die parts being arranged above the other die part in said at least one direction in which the first surface extends rectilinearly, to and from a powder-filling position on top of said opening in the first surface of the one of the die parts being arranged above the other die part.

13. A device according to claim 9, wherein the second punch is arranged so as to be advanced through the second die part to a final compaction position at which the punch edge is at a distance so short from the inner peripheral surface of said chamber of the first die part that, upon compaction of a powder introduced into said cavity, an edge of the compacted green body will be formed in the region in which said punch edge is adjacent to said inner peripheral surface.

14. A device according to claim 13, wherein the second punch is arranged to be advanced until the distance between the punch edge and the inner peripheral surface of said chamber is equal to or less than 50 μm, equal to or less than 30 μm, equal to or less than 10 μm, or equal to or less than 5 μm.

15. A device according to claim 13, wherein, when the second punch is in a final compaction position, the distance in the direction of the pressing axis from the level of the punch edge to a level of the edge that defines the opening in the second surface of the first die part is within the range of 10-500 μm.

16. A device according to claim 9, wherein a region around said opening in the second end surface of the second die part has a curvature corresponding to the curvature of the edge that defines the opening in the second end surface of the first die part, such that the second end surface of the second die part will be in sealing relation with said edge of the opening in the second end surface of the first die part when the first and second die parts are contiguously arranged.

17. A device according to claim 9, wherein, when the first and second die parts are contiguously arranged, the second surface of the second die part overlaps the opening in the second end surface of the first die part, thereby forming an overlapping rim around said opening said second end of the first die part.

18. A device according to claim 9, wherein the die includes an outer die part that at least partially laterally encloses the first and second die parts when those are contiguously arranged, and that the outer die part has an upper surface that coincides with the first surface of the one of the die parts being arranged above the other die part when the latter is contiguously arranged in relation to the one of the die parts being arranged below the other die part and the device is in a position ready for filling of powder into said cavity.

19. A device according to claim 9, wherein the one of the die parts being arranged above the other die part presents an extension that overlaps the lower die part when the first and second die parts are joined and that comprises a lateral opening which is exposed when the one of the die parts being arranged above the other die part is retracted from the position in which it is contiguously arranged in relation to the other die part, such that a compacted green body, which is exposed as a result of said retraction of the one of the die parts being arranged above the other die part and a displacement of the green body out of the first die part in the direction of the pressing axis, is laterally exposed through said opening.

20. A device according to claim 9, wherein the cutting insert green body has the shape of a positive cutting insert, and that the inner peripheral surface of said chamber in the first die part has a corresponding shape, with a cross section cross wise to the pressing axis that increases towards the opening in the second surface of the first die part.

21. A device according to claim 9, wherein the second die part is the one of the die parts arranged above the other die part.

22. A device according to claim 9, wherein the first die part is the one of the die parts arranged above the other die part.

* * * * *